US008231007B2

(12) United States Patent
Wark

(10) Patent No.: US 8,231,007 B2
(45) Date of Patent: Jul. 31, 2012

(54) STATIC CLASSIFIER CAGE

(76) Inventor: Rickey E. Wark, The Woodlands, TX (US)

( * ) Notice: Subject to any disclaimer, the term of this patent is extended or adjusted under 35 U.S.C. 154(b) by 251 days.

(21) Appl. No.: 12/361,829

(22) Filed: Jan. 29, 2009

(65) Prior Publication Data

US 2010/0187164 A1 Jul. 29, 2010

(51) Int. Cl.

| | |
|---|---|
| ***B07B 7/00*** | (2006.01) |
| ***B07B 4/00*** | (2006.01) |
| ***B03B 5/64*** | (2006.01) |
| ***B03B 5/60*** | (2006.01) |

(52) U.S. Cl. ..... 209/139.1; 209/138; 209/713; 209/714; 209/154

(58) Field of Classification Search ..... 209/138, 209/139.1, 713, 714, 154; 415/209.3
See application file for complete search history.

(56) References Cited

U.S. PATENT DOCUMENTS

| | | | | | |
|---|---|---|---|---|---|
| 1,598,702 | A | * | 9/1926 | Bell et al. | 241/30 |
| 2,004,750 | A | * | 6/1935 | Eckhard | 192/76 |
| 2,304,264 | A | * | 12/1942 | Lykken | 241/39 |
| 2,522,233 | A | * | 9/1950 | Merrill | 310/156.77 |
| 2,587,609 | A | * | 3/1952 | Fisher | 241/39 |
| 2,654,294 | A | * | 10/1953 | Morden | 241/259.1 |
| 2,683,561 | A | * | 7/1954 | Rice | 229/117.01 |
| 2,932,485 | A | * | 4/1960 | Small, Jr. et al. | 415/137 |
| 3,015,391 | A | * | 1/1962 | Sharples | 209/135 |
| 3,042,202 | A | * | 7/1962 | Work | 209/135 |
| 3,799,694 | A | * | 3/1974 | Duzan | 415/161 |
| 4,038,821 | A | * | 8/1977 | Black | 60/398 |
| 4,119,389 | A | * | 10/1978 | Gee | 415/189 |
| 4,476,407 | A | * | 10/1984 | Hildebrandt et al. | 310/71 |
| 4,508,619 | A | * | 4/1985 | Niitti et al. | 209/169 |
| 4,585,964 | A | * | 4/1986 | Hildebrandt | 310/71 |
| 4,724,620 | A | * | 2/1988 | Hsu | 34/174 |
| 4,934,900 | A | * | 6/1990 | Schonbach et al. | 415/209.3 |
| 5,691,589 | A | * | 11/1997 | Keim et al. | 310/156.29 |
| 5,731,156 | A | * | 3/1998 | Golbus | 435/7.1 |
| 5,957,300 | A | * | 9/1999 | Nardi et al. | 209/143 |
| 6,109,448 | A | * | 8/2000 | Konetzka et al. | 209/135 |
| 6,276,534 | B1 | * | 8/2001 | Huang et al. | 209/139.2 |
| 6,318,559 | B2 | * | 11/2001 | Cordonnier et al. | 209/154 |
| 6,375,410 | B2 | * | 4/2002 | Clouse et al. | 415/9 |
| 6,405,948 | B1 | * | 6/2002 | Hahn et al. | 241/1 |
| 6,565,026 | B1 | * | 5/2003 | Hall | 241/225 |
| 7,028,847 | B2 | * | 4/2006 | Chen et al. | 209/713 |
| 7,028,931 | B2 | * | 4/2006 | Lin et al. | 241/79.1 |
| 7,104,403 | B1 | * | 9/2006 | Stephens et al. | 209/20 |
| 2003/0231957 | A1 | * | 12/2003 | Anderson et al. | 415/208.2 |
| 2004/0109762 | A1 | * | 6/2004 | Hidalgo et al. | 415/209.3 |

* cited by examiner

*Primary Examiner* — Stefanos Karmis
*Assistant Examiner* — Michael E Butler
(74) *Attorney, Agent, or Firm* — Young Basile Hanion & MacFarlane PC

(57) ABSTRACT

A static classifier cage is formed in upper and lower tiers of circumferentially spaced bar-shaped vanes of wear-resistant material. The lower tier is formed by and between a bottom ring and an intermediate ring. The top tier is formed by and between the intermediate ring and a topmost ring. In each tier, the lowermost ring is provided with slots to receive and act as a seat for the vertically oriented vanes while the upper ring in the tier is provided with radially outwardly opening notches into which the vanes are moved in a radial fashion. After the vanes are installed, a retainer is fastened into position to prevent the vanes from backing out of the notches.

1 Claim, 5 Drawing Sheets

STATIC CLASSIFIER CAGE

FIELD OF THE INVENTION

This invention relates to classifier cages of the type used in coal and mineral ore processing equipment and more particularly to an improved classifier cage which substantially facilitates installation, repair and reconstruction.

BACKGROUND OF THE INVENTION

Classifiers are commonly used as equipment for processing coal and mineral ore to separate smaller, fully processed particles from larger, insufficiently processed clumps or chunks. The typical classifier comprises a static outer cage made up of vertical bars or vanes arranged and anchored in a cylindrical pattern with spaces between the bars to permit air flow. A dynamic cage is mounted concentrically within the static cage for rotation about a vertical axis at the center of the structure. An air stream flows through the cages and ore is fed in from the top.

Because of the heavy and abrasive nature of the material being processed by the classifier, the vertical bars of both the static and dynamic cages are subject to a high degree of wear, particularly near the lower ends. As a result, it is common to require periodic reconstruction of at least the static classifier cage. This is a difficult and laborious job requiring disassembly of the upper classifier structure including the motor that rotates the interior cage and the support structure for the motor. Thereafter, the long heavy bars must be lifted vertically upwardly for removal purposes. If they are to be inverted and reused, their length and weight is such as to make the inversion a difficult step. Thereafter, the inverted bars are lowered back into position and reinstalled. The down time required to invert and reinstall all of the bars is substantial and results in an expensive loss of production.

SUMMARY OF THE INVENTION

The present invention provides an improved static classifier cage structure which dramatically reduces the difficulty and lime required to install, repair or reconstruct the cage thereby dramatically reducing the down lime involved in such a procedure.

According to a first aspect of the present invention, the static classifier cage structure is provided with at least two vertically spaced apart coaxial rings and a plurality of bars or vanes which can be installed to and between the rings by lateral insertion of the bars into notches in one or both of the rings. This eliminates the need to disassemble the upper classifier structure and remove bars vertically.

In the preferred form, the upper and lower rings are fabricated in multiple sectors and are provided with slots and/or notches which substantially conform to the cross-sectional configuration of the bars, thus to allow at least one end of each bar to be moved laterally into the installed position by entering an open-ended notch, after which a retainer member is attached. Preferably, the bottom surfaces of the bars are either radiused or beveled to permit the bars to be tilled or rocked into position in the lower ring slots.

In accordance with a second aspect of the invention, repair and/or reconstruction of a static classifier cage is facilitated by dividing the cage into upper and lower tiers, each having its own set of bars, thereby substantially shortening the length of the bars and reducing the weight and difficulty of handling such bar in a repair and/or reconstruction process as well as in original construction.

In accordance with the second aspect of the invention, classifier cages are made up of bottom, intermediate and topmost rings arranged in spaced apart, coaxial fashion. A first plurality of bars is installed between the bottom and intermediate rings and a second plurality of bars is arranged between the intermediate and topmost rings. The bars in the two tiers are preferably equal in number and spacing, but may be of different lengths as shown herein. In accordance with the preferred embodiment, the rings are configured so as to allow at least one end of the bars to slide radially into peripherally opening notches, thus making it unnecessary to lift any of the blades up through the top of the structure. Retainer members hold the bars in place after installation.

The invention and the method of constructing, repairing or reconstructing same will be best understood from a reading of the following specification which describes an illustrative embodiment in detail. In this description, the term "bars", "vanes", "vane members", and "vane bars" are used interchangeably.

BRIEF SUMMARY OF THE DRAWINGS

The description herein makes reference to the accompanying drawings wherein like reference numerals refer to like parts throughout the several views and wherein.

DETAILED DESCRIPTION OF AN ILLUSTRATIVE EMBODIMENT

Figure 1:
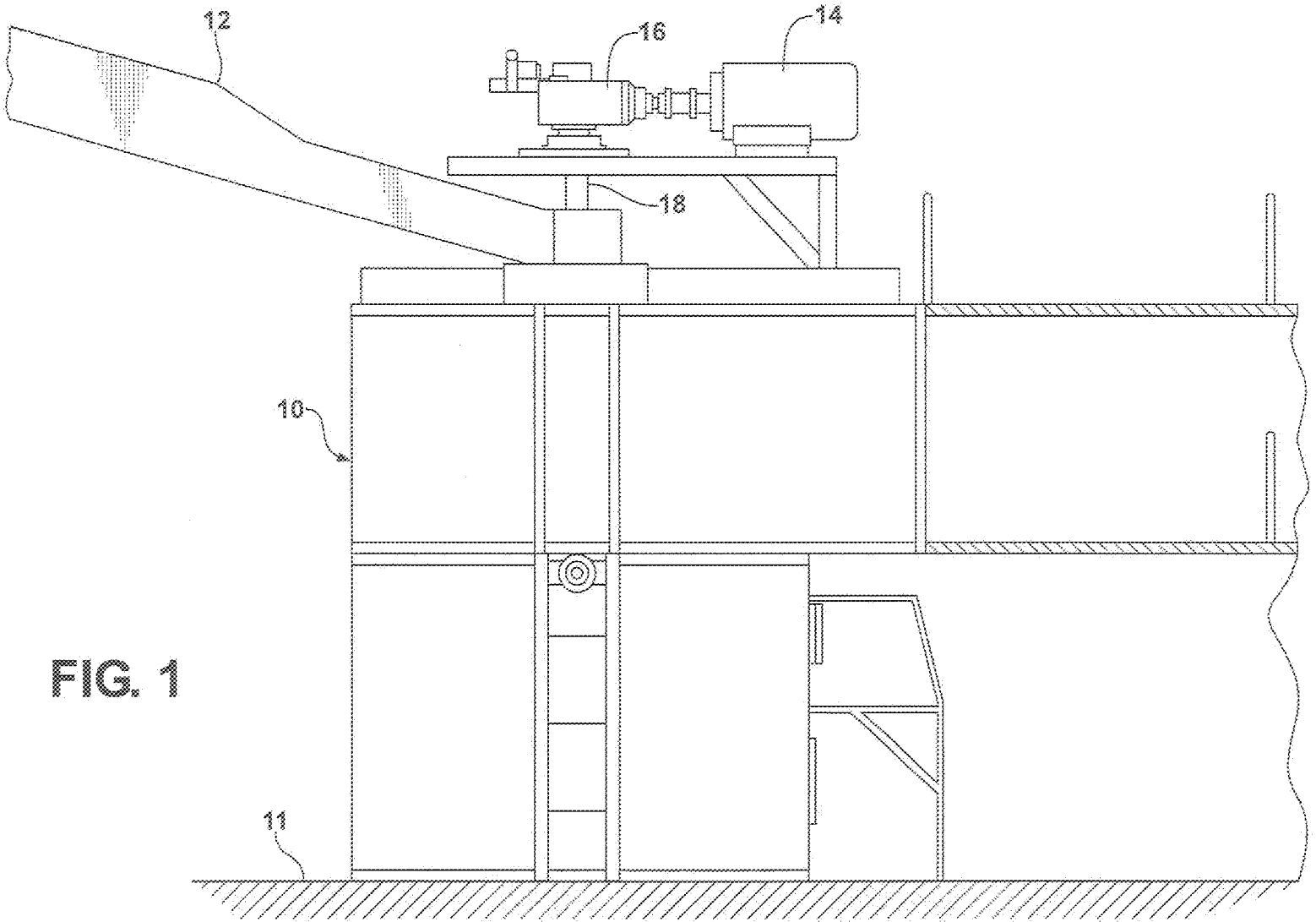
FIG. 1 is a side view of a conventional classifier of the type suitable for use with the present invention.

Referring first to FIG. 1, there is shown a convention ore classifier 10 mounted on a foundation 11 and equipped with a gravity feed input chute 12 which feeds ore into the center of the classifier within the housing 10. A dynamic classifier cage (not shown) is driven in rotation by a motor 14 which is connected through a reduction drive 16 to drive shaft 18 to rotate the dynamic inner classifier cage within an outer static classifier cage to be described hereinafter with reference to FIGS. 2 and 3.

Figure 2:
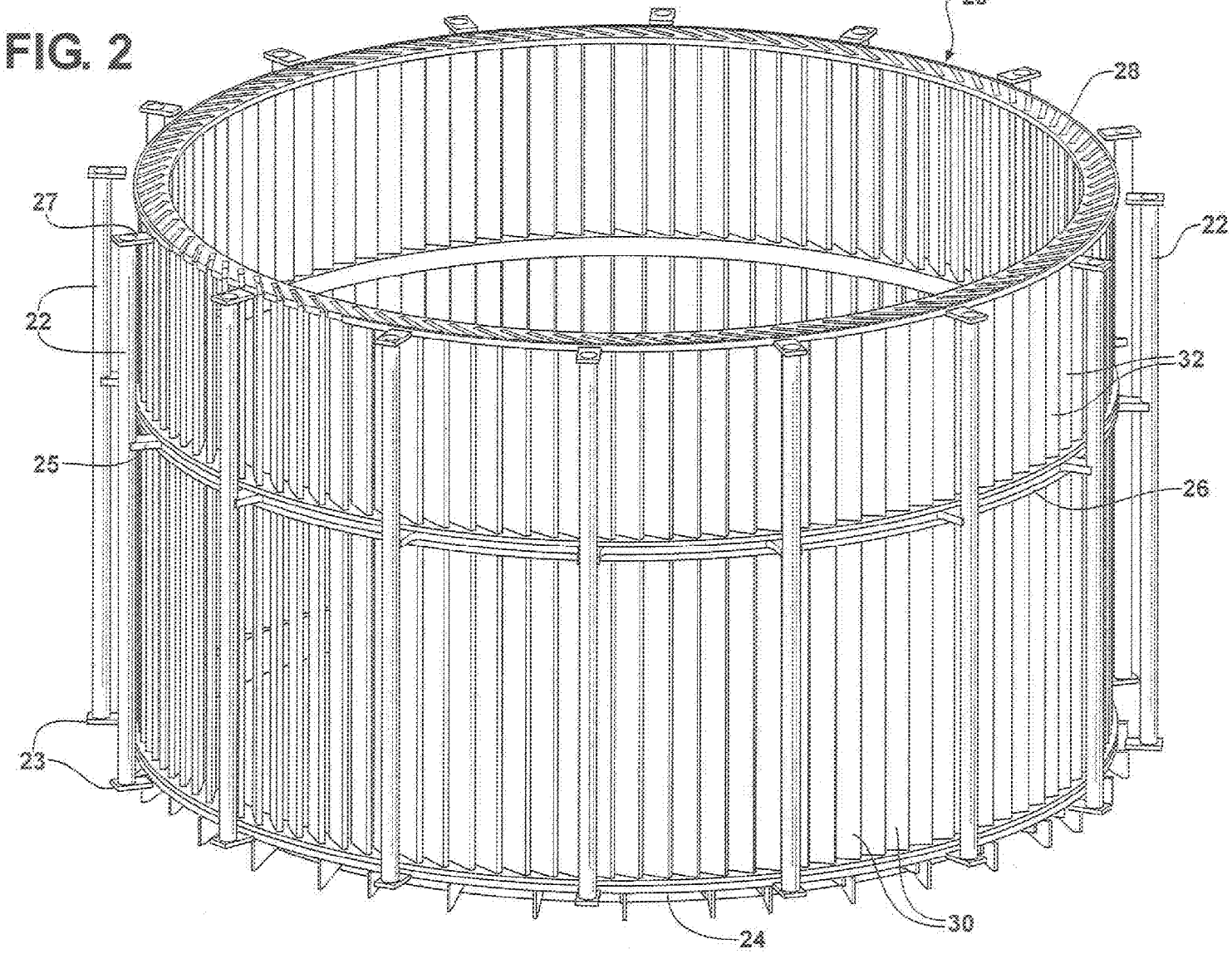
FIG. 2 is a perspective view of a static classifier cage embodying the present invention.

Referring now to FIG. 2, there is shown a static classifier cage 20 which is generally cylindrical in shape and constructed in two tiers; i.e., a lower tier made up largely of vertically oriented, circumferentially uniformly spaced classifier vanes 30 and an upper tier made up of shorter, vertically oriented, circumferentially spaced vanes 32.

The classifier cage 20 is mounted within an external support structure consisting of steel vertical support columns 22. The classifier cage 20 is made up of a lower ring 24, an intermediate ring 26 and an upper ring 28, the rings 24, 26, 28 providing receiving supports for the vertical vanes 30, 32 as hereinafter described. The support columns 22 are connected to the rings by way of welded radial supports 23, 25, 27 respectively.

Figure 3:
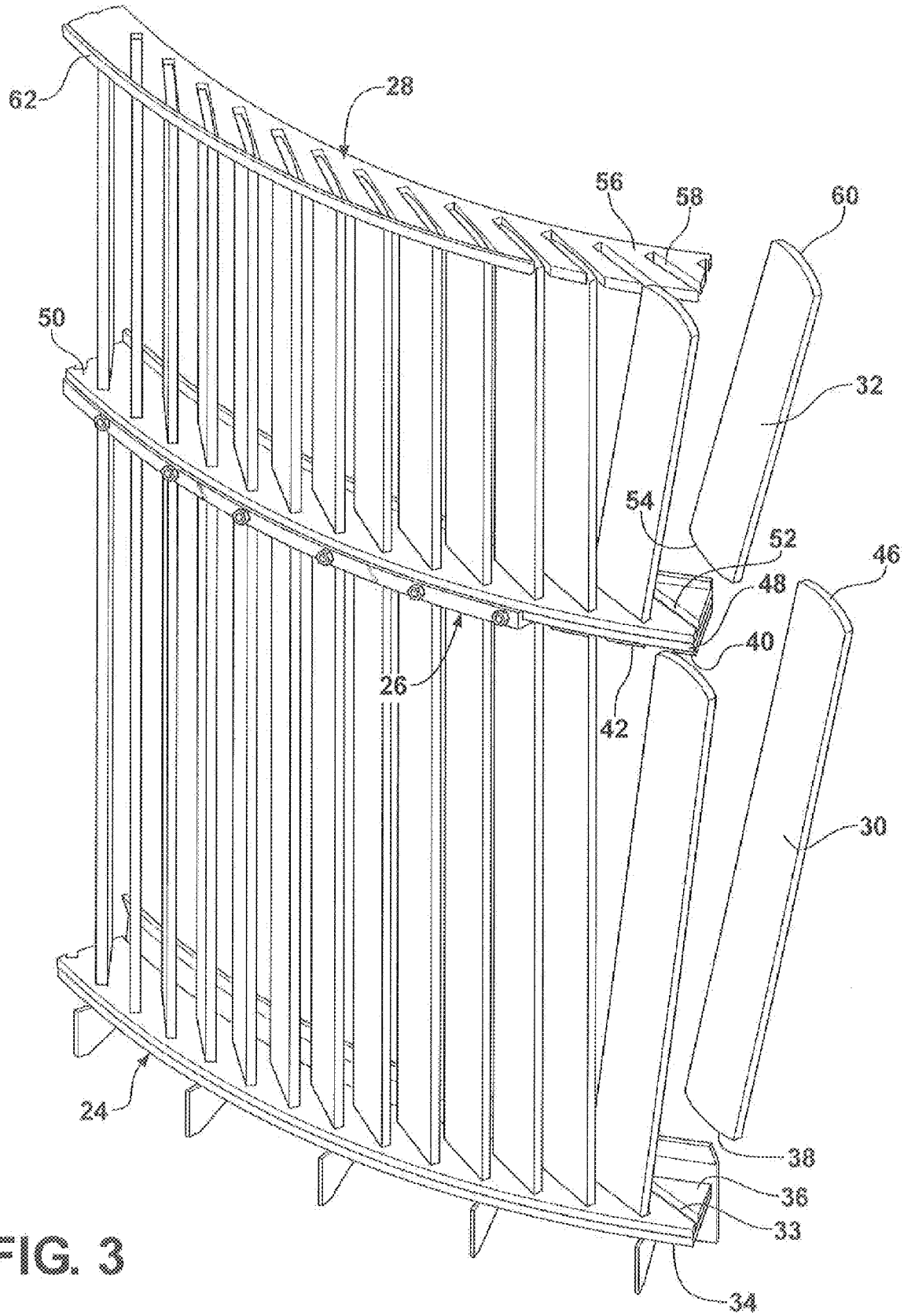
FIG. 3 is a perspective view of a portion of the static classifier cage illustrating how the upper and lower tier vane bars are installed.

Describing the classifier cage 20 in greater detail and with reference to both FIG. 2 and FIG. 3, the lower ring 24, although it appears circumferentially continuous in the drawings, is typically made up of a number of sectors, each of which consists of an arcuate steel base plate 34 and, resting immediately on top of the base plate 34, an arcuate steel plate 36 into which angled slots 33 are cut so as to receive and provide a seat for the lower ends 38 of the lower tier classifier vane bars 30. As shown in FIG. 3, the slots 33 do not extend all the way to the radially outermost edge of the plate 36. As also shown in FIG. 3, the lower ends 38 of the vane bars 30 are either radiused or beveled at the innermost and outermost corners to permit the vane bar to be dropped into the seat provided by the slot 33 in a slightly outwardly tilted condition and thereafter rocked into place as hereinafter described. Plates 34 and 36 are joined by welding or other conventional measures.

Figure 4:
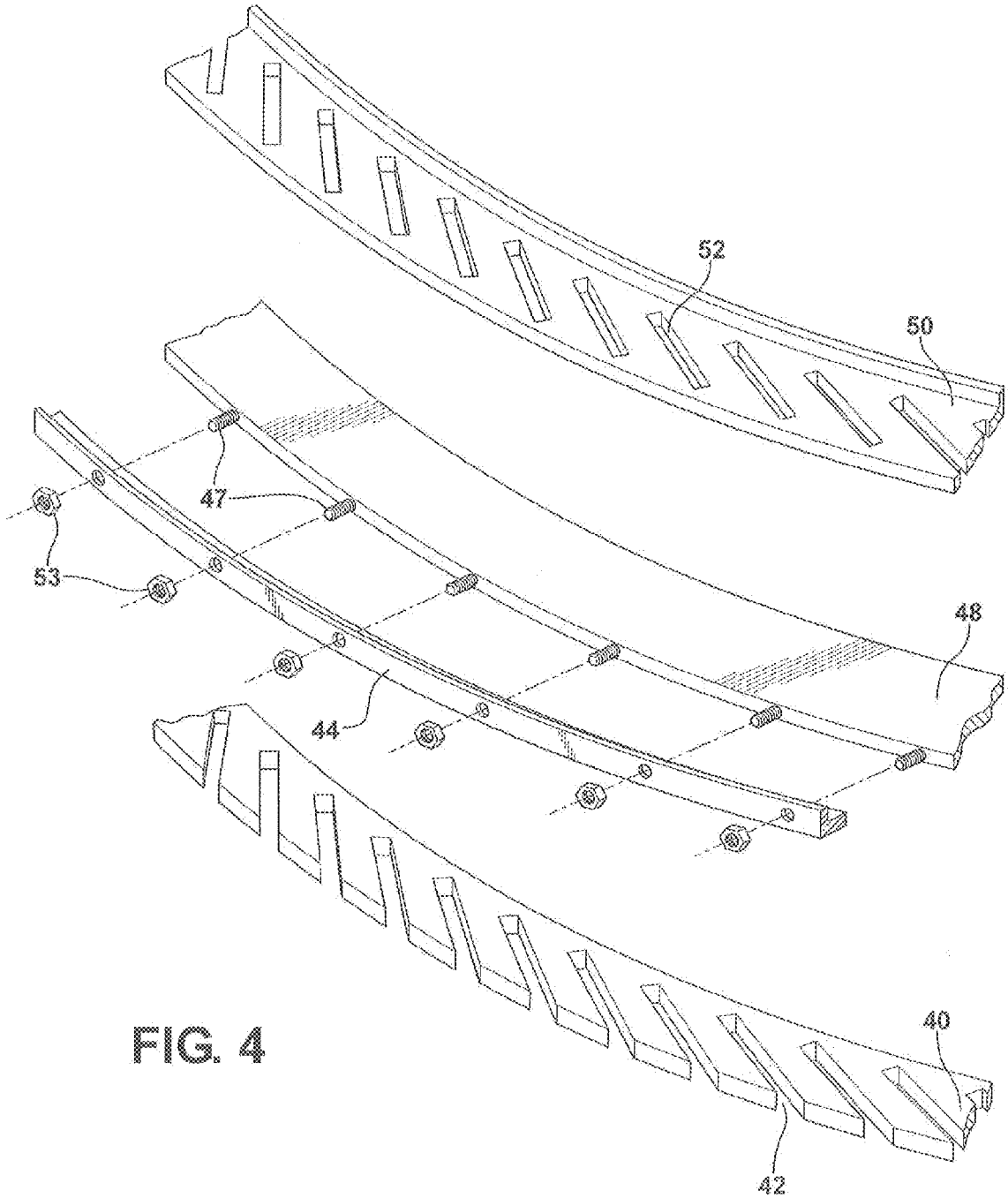
FIG. 4 is an exploded view of a portion of the classifier cage showing how the retainer member is built and installed.
Figure 5:
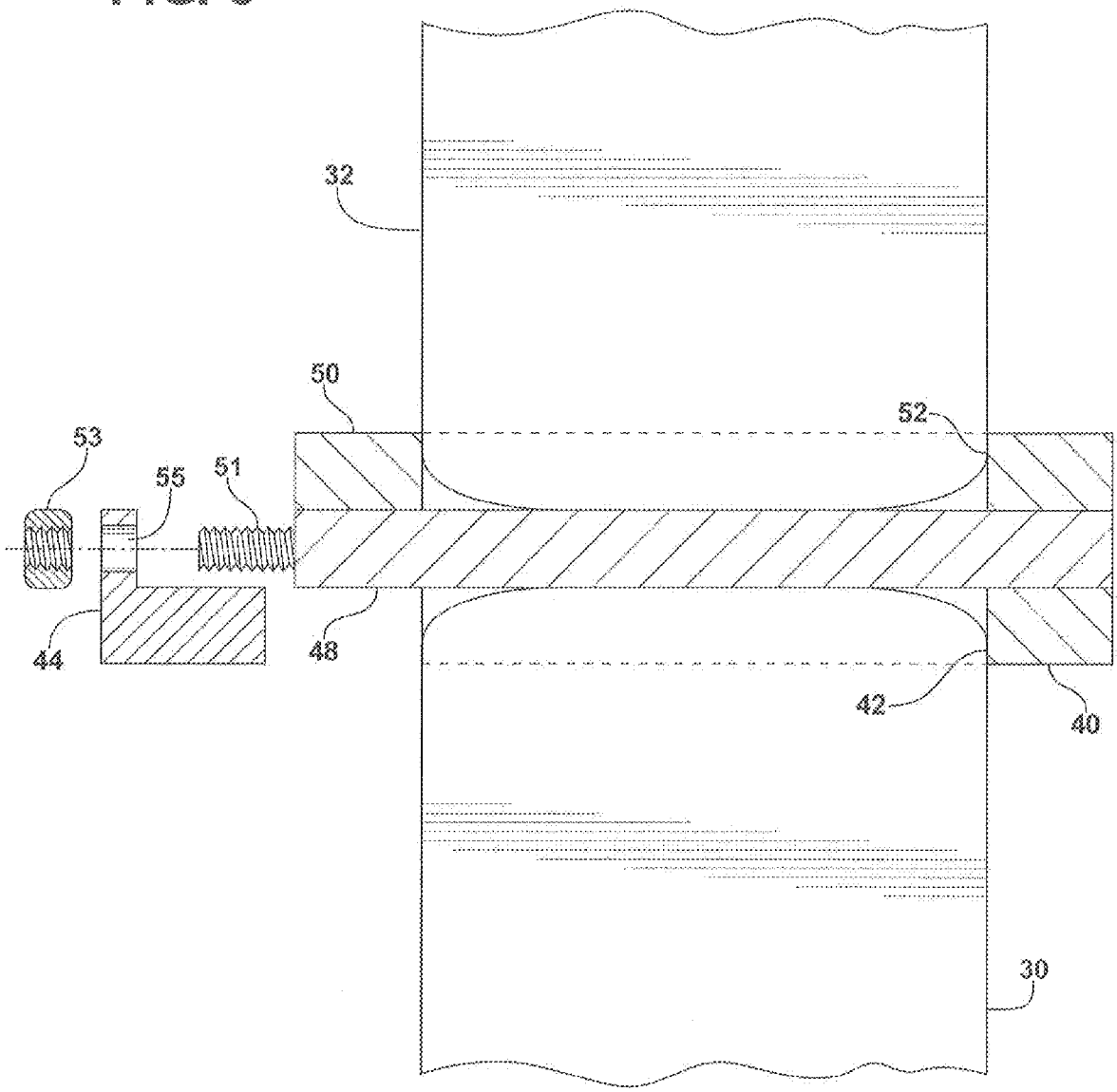
FIG. 5 is a sectional view of the middle ring showing how a retainer member fits.

The intermediate ring 26 is made up of three plates 40, 48 and 50, all of which are welded together to form a unified assembly. The arcuate lower plate 40 is provided with notches 42 that extend all the way to the outside peripheral edge to receive the upper end 46 of each of the lower tier vane bars 30. The arcuate middle plate 48 sits on top of plate 40 as shown in FIG. 5 and has threaded studs 51 welded to the outside edge at spaced intervals as shown in FIG. 4. The lowermost arcuate plate 40 is shallower than the middle plate 48 such that the outer edge thereof is radially inwardly offset or recessed relative to the outer edge of the plate 48. Thus, the outer edge of the bar 30 lines up with the outer edge of plate 40 when fully inserted; see FIG. 5. The uppermost plate 50 sits on top of plate 48 and contains angled slots 52 to receive the bottom of the upper tier vane bars 32. Retainer member 44 is arcuate; i.e., has the same effective radius as the outer edge of plate 48 and has holes 55 formed at spaced intervals to receive the studs 51 therethrough during installation. Retainer 44 is stepped as shown in FIG. 5 to fit against the outer edge of plate 40 to prevent outward movement of a vane bar 30 in notch 42. Nuts 53 hold the retainer members 44 in place. The arc length of the retainer 44 is not critical and will be chosen for convenience of handling and fabrication.

The uppermost plates 56 in ring 28 are slotted all the way to the outer edge as shown as 58 to receive the upper ends 60 of the upper tier vane bars 32 therein. Once all of the vane bars 32 in a given sector are in place, a curved retainer plate 62 is bolted or otherwise fastened in place. Each retainer has holes for securing threaded studs welded to the outer edge of the ring 28 exactly as described below for ring plates 48 with studs 51. Since the vane bars 30, 32 are inevitably to be replaced from time to time, it is preferable that the retainers 44, 62 be bolted in place so that they may be easily removed and reinstalled from lime to time, as needed.

From the foregoing, it will be apparent that the ring structures 24, 26, 28 are all coaxial and spaced apart from one another to define the lower and upper tiers, the spacing being such as to correspond essentially to the lengths of the vane bars 30, 32, respectively. To construct, repair or reconstruct the classifier cage 20, the retainers 44, 62 are removed as described above and the bars 30, 32 are rocked outwardly from the top until they are free of the slots 42, 58, respectively. The bars 30, 32 may then be either inverted or completely replaced depending on their conditions. To place either new or inverted bars back into place, it is a simple matter to drop the lower ends 38 into the slots 33, 52 and thereafter rock the bars into the upper end notches which extend all the way to the outer periphery of the respective ring structures 26, 28. Thereafter, when a sector has been completely filled with bars, the appropriate retainer ring 44 or 62 is reinstalled to hold the bars in place.

The components of the structure shown in FIGS. 2 and 3, and particularly the bars 30, 32 are preferably made from highly wear-resistant materials including various steel alloys, steel plates with wear-resistant coatings applied thereto and plates or bars made of high wear-resistant material such as aluminum oxide, tungsten carbide and the like.

It will be understood that while the invention has been illustrated and described with respect to a two tier structure in which the upper and lower tiers are of unequal length, the invention is also useful in single tier structures and in multi tier structures, in which the tiers are all of the same vertical height, thereby to permit stocking of a single length of vane bars for the construction, repair and/or reconstruction process. The more tiers used, the lighter the vane bar for those tiers and therefore, in a classifier of greater height than that shown in FIGS. 2 and 3, three or more tiers of equal or unequal height may be employed.

It may also be apparent that the slots for any given bar are angled the same with respect to the radius; e.g., approximately 45-50° from a pure radial orientation, thereby to accommodate the air flow which is inherent in classifiers of the type illustrated herein. The classifier 20 may be used for various types of ore including gold bearing ore, as well as with other crushable materials, such as coal. While the invention has been described with reference to an embodiment with open-ended notches at only one end of each vane bar, this structure, along with suitable retainer members, can be used at both ends; i.e., on each of the upper and lower rings in each tier.

The vane bars 30, 32 are generally rectangular, but the end surfaces thereof are preferably radiused or beveled as shown at 38 to facilitate insertion thereof into the ring structures is a slightly outwardly tilted orientation. Typically, the bottoms of the bars 30, 32 are set into their respective slots 33, 52 and then rocked inwardly until the top edges go fully into the notches 42, 58 respectively. The vanes 30 line up with the vanes 32 and are equal in number and spacing.

What is claimed is:

1. A method of reconstructing a static classifier cage wherein the method comprises the steps of:

providing a static classifier cage having upper and lower axially spaced-apart and coaxial rigid ring structures wherein at least one of said rings has a plurality of notches extending at an angle relative to a radius of said cage to an outside edge thereof;

fitting a plurality of hardened metal elongate, generally rectangular classifier vanes into and extending between said rings in a cylindrical pattern by receiving the ends of said vanes into said notches for retention purposes;

removing an arcuate retainer which closes the outer ends of said notches;

removing at least one of said vanes from their normal vertical orientation between said rings by substantially radially outward translation from said notches;

performing at least one of inverting at least some of said removed vanes and restoring them in inverted orientation into contained relationship between said upper and lower ring structures or replacing said removed vanes with unworn vanes within said notches; and replacing said arcuate retainer to close the outer ends of said notches.

* * * * *